US006491462B1

(12) United States Patent
Juan et al.

(10) Patent No.: US 6,491,462 B1
(45) Date of Patent: Dec. 10, 2002

(54) AUTOMATIC PRINT MEDIA HANDLING

(75) Inventors: Fernando Juan, Barcelona; Juan Carlos Hernandez, Barcelona, both of (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/506,738

(22) Filed: Feb. 18, 2000

(30) Foreign Application Priority Data

Feb. 19, 1999 (EP) ..... 99103274

(51) Int. Cl.[7] ..... B41J 29/18
(52) U.S. Cl. ..... 400/703; 400/608
(58) Field of Search ..... 400/703, 706, 400/707.1, 596, 599, 601, 607, 607.2, 624, 605

(56) References Cited

U.S. PATENT DOCUMENTS

| | | | | | |
|---|---|---|---|---|---|
| 4,569,610 | A | * | 2/1986 | Drejza et al. | 400/599 |
| 4,639,154 | A | * | 1/1987 | Myers | 400/584 |
| 4,674,899 | A | | 6/1987 | Kimura | 400/605 |
| 5,088,717 | A | * | 2/1992 | Hamanaka et al. | 271/98 |
| 5,141,346 | A | * | 8/1992 | Nakagawa | 400/605 |
| 5,219,236 | A | * | 6/1993 | Kamimura et al. | 400/605 |
| 5,391,008 | A | * | 2/1995 | Hattori | 400/605 |
| 5,534,989 | A | * | 7/1996 | Rubsha et al. | 355/309 |
| 5,718,526 | A | | 2/1998 | Yokota | 400/605 |
| 5,947,408 | A | * | 9/1999 | Miyake | 242/562 |
| 6,019,532 | A | * | 2/2000 | Harris et al. | 400/708 |

FOREIGN PATENT DOCUMENTS

| | | |
|---|---|---|
| EP | 0 358 192 A2 | 3/1990 |
| EP | 0 427 290 A2 | 5/1991 |
| EP | 0 671 277 A1 | 9/1995 |

* cited by examiner

*Primary Examiner*—Andrew H. Hirshfeld
*Assistant Examiner*—Darius N. Cone

(57) ABSTRACT

A printer for printing on a first medium in the form of a continuous band or on a second medium in the form of a sheet, in a print zone of the printer, is provided. The printer comprising a movable cover giving access to the print zone for loading said second media, a hold down system for holding said second media in position before and during printing, a first sensor to detect opening of the cover linked to said hold down system, storage means for storing said first medium, a feeder for moving said first medium from the storage means to the print zone, wherein when the cover is opened by a user of the printer the sensor activates the hold down system to accept said second medium without any further action by said user. The printer may have a second sensor for activating the feeder to withdraw the first medium from a ready to print position to a standby position while simultaneously moving the second medium through the print zone.

13 Claims, 9 Drawing Sheets

AUTOMATIC PRINT MEDIA HANDLING

FIELD OF THE INVENTION

This invention relates, in general, to print media feed apparatus for hard copy printing devices capable of operating with printing media in continuous band or sheet form and, more particularly, to large format ink jet printers, plotters and the like with the ability to, interchangeably, handle a continuous media in roll form and/or cut sheets.

BACKGROUND OF THE INVENTION

An ink jet printer mechanism is a non-impact printing device which forms characters and other images ejecting ink droplets, in a controllable manner, from a print head. The ink jet mechanisms can be used in different devices, such as printers, plotters, facsimile machines, copiers and the like. For the sake of convenience reference shall hereinafter be made solely to large format ink jet printers or plotters, to illustrate the concepts of the present invention.

The printhead of a machine of the kind mentioned ejects ink through multiple nozzles as minuscule droplets, which "fly" over a short space and strike a printing media. Different nozzles are used for different colours. Ink jet printers usually print within a range of 180 to 2400 or more dots per inch. The ink thus deposited on the media is immediately dried after being deposited to form the desired printed images.

There are several types of ink jet printheads, for example, thermal print heads and piezoelectric ones. By way of example, in a thermal ink jet printhead, the ink droplets are ejected from individual nozzles by localized heating. Each of the nozzles has a small heating element. An electric current is made to pass through the element to heat it. This causes a tiny volume of ink to be heated by the heating element and vaporized instantaneously. On vaporization the ink is ejected through the nozzle. An exciter circuit is connected to individual heating elements to supply energy impulses and, in this way, to deposit in a controlled way droplets proceeding from associated individual nozzles onto the media. These exciter circuits respond to character generators or other imaging circuits to activate selected nozzles of the printhead to form the desired images on the media.

The ink nozzles customarily form part of an ink cartridge, disposable or otherwise, and the printhead of a printer of the kind to which the invention refers can have cartridges mounted for different ink colours, for example, cyan, magenta, yellow and black. These are arranged in the carriage in such a way that their nozzle sections are to be found very close to the surface of the support platen of the media, but separated therefrom, for the purpose of allowing the passage of said media between them. The carriage moves the printhead back and forth through the printing zone in one direction, called the scan direction, the location of the carriage in the printing zone being constantly controlled thanks to codifying means which control an actuating motor, for example a stepping motor.

In machines of this type there is generally used, as media, a band of paper of large width, for example D and E size, arranged in rolls of up to 90 m. in length. A 90 m. roll of E size paper can weigh almost 8 kg., so precautions should be taken at the time of handling it.

Such handling is even more difficult if we consider that the face of the media band on which the printing is performed is the external face and that a large part of the media used in a machine of the kind to which the invention refers have a coated surface which is sensitive to contact with the operator's hands, such that the operator should as much as possible avoid touching said printing surface during operation while, at the same time, keeping it clean and away from objects that could harm or scratch the media surface.

Moreover, for certain printing tasks the operator may have to utilize media in the form of large cut sheets, for example in A, B, C, D and E formats, as well as in formats utilized in Architecture. Such pre-cut sheets can easily spoil during handling, especially the larger sized ones. Care should be taken when removing the media from the packet and during its insertion and adjustment in the printer and, furthermore, care should be taken to touch the media only at the edges, to avoid harming or soiling the area on which the printing has to take place.

Once the printing task concludes, the machine automatically cuts the media (this does not occur in the case of printing on individual sheets) and the media, in one or the other case, is allowed to drop on to the output tray, with the possibility of the ink still not having dried completely with the resulting risks this entails, i.e., that the printed work may be spoilt during initial handling of the media.

In the prior art printing machines of different types are already known (impact or ink jet, for example) which are capable of printing both on continuous media and on cut sheets. A known machine of this type makes use of a "parking" facility of the continuous paper while operating with cut sheets fed manually.

For example, from U.S. Pat. No. 5544966 a printer is known which, provided with at least one tractor for continuous paper, allows the use of cut sheets to print while the continuous paper is "parked" outside the printing area. This machine achieves this interchangeable feeding by the provision of, at least, two different pathways for paper input (continuous and cut sheets), a third pathway being foreseeable for the input of continuous paper, likewise with the intervention of a tractor (the one cited or another additional one) for paper.

In the first place the printer to which said document of the prior art refers, is of small format and provided with tractors for the input of paper, which can be fed into it in continuous band, folded zig-zag, with the usual perforations in the margins or in the form of loose sheets, of small format.

In the second place, in said printer of the prior art is necessary to change the turning direction of the main roller to take the continuous medium towards a parking position, beyond the printing area and out of contact with said main roller prior to being able to feed cut sheets.

Large-format printers are also known, to allow parking of a print medium supplied starting from a roll and feeding in, in its place, a cut sheet to perform a printing operation on it. These prior art printers have two superimposed openings for input of the printing medium: one for the supply starting from a roll and another for the supply as cut sheet. However, the said two superimposed openings give way to a single advance path of the printer medium.

In machines of this type, when a user wishes to perform a printing task on a cut sheet in a printer loaded with continuous medium, the printer has to be requested, in the first place and by pressing a control panel button, to withdraw the continuous medium from the printing area, making it recede separating it from the main feeder roller and parking it, by a deviator which completely withdraws it from the main advance roller. In the second place, the user has to manually insert the medium in cut sheet form into the suitable opening, operation of which is bothersome, since the manipulation of said cut sheet is difficult, owing to its extreme width and, in particular, because of the close arrangement of said two input openings (which are, moreover, hidden from the operator's view), the most likely result being that the cut sheet will be fed into the wrong opening, already occupied by the parked continuous medium. Finally, by means of another push-button in the control panel, the user has to make the machine load the paper in sheet form until the printing area.

Moreover, the input path of the means in sheet form is practically mutual with that of feed in of the medium in cut sheet form and it is not possible to supply said cut sheet simultaneously with removal of the medium fed in starting from a roll.

SUMMARY OF THE INVENTION

According to the present invention there is provided, a printer for printing on a first medium in the form of a continuous band or on a second medium in the form of a sheet, in a print zone of the printer, the printer comprising a movable cover giving access to the print zone for loading said second media, a hold down system for holding said second media in position before and during printing, a first sensor to detect opening of the cover linked to said hold down system, storage means for storing said first medium, a feeder for moving said first medium from the storage means to the print zone, wherein when the cover is opened by a user of the printer the sensor activates the hold down system to accept said second medium without any further action by said user.

Accordingly, one aim of embodiments of the present invention is to provide a system for automatically changing the manner of feeding the printing medium into a printer of the kind specified in the preamble of this specification, between a manner of feeding in the medium in continuous band form and a manner of feeding in the medium in cut sheet form with little intervention by the operator.

Embodiments of the invention provide two different input paths for the medium: one for continuous medium and the other for medium in cut sheet form.

An operator can load continuous media into the machine starting from a roll of the same and perform a printing task; afterwards he can load a cut sheet without touching the media roll, perform another printing thereon and, after withdrawing said cut sheet, he can once again operate with continuous media from the roll without at any time touching the media.

To achieve this, in the advance path of the medium, there is provided an auxiliary driver axis provided with, at least, one roller and arranged transversally respecting the direction of advance of the medium, between a first input roller intended to guide the medium and the main roller feeding in the same, whose auxiliary driven axis can adopt a first position, in which it is to be found separated from the path of the medium fed in starting from a roll, and a second position in which it is applied with said medium, which is grasped between said at least one roller of the auxiliary driven axis and by at least one roller assembled in a supporting axis arranged to turn freely (whose geometrical axis is parallel to the geometrical axis of said auxiliary tractoraxis) such that said continuous medium can be made to advance and/or retrocede along said advance path.

In its turn, said auxiliary axis, when in said second position of application with the continuous means, can adopt a first condition, in which it turns freely, allowing advance of the medium removed from said input roll until the medium achieves a "READY" position (prepared for printing) in the printing area of the machine and while a printing operation is performed on it, and a second condition, in which it is actuated in a first turning direction to make said continuous medium recede, removing it from the printing area and from the main pulling roller and taking it to a "STAND BY" or "parking" position, during which the printer can be carrying out a printing operation on a cut sheet, or in which it is actuated in the opposite direction to said first turning direction, to once again feed in said continuous medium that was parked, until taking it to the ready to print position, in said printing area.

BRIEF DESCRIPTION OF THE DRAWINGS

In what follows a preferred embodiment of the invention will be described, solely by way of example and making reference to the attached drawings, in which.

DETAILED DESCRIPTION OF THE INVENTION

Figure 1:
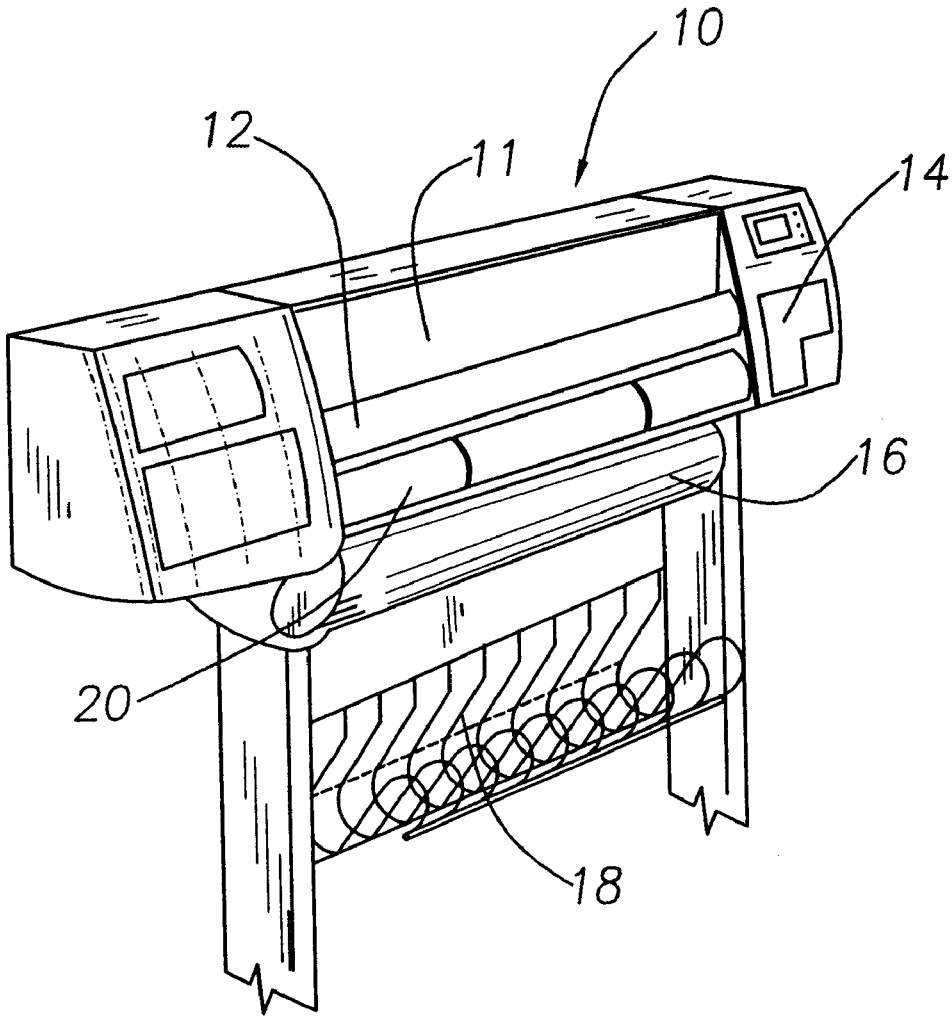
FIG. 1 is a perspective view of a large format ink jet printer, which incorporates the invention.

In FIG. 1 an ink jet printer is illustrated generally, of the type mentioned in the preamble of this specification, in this case a large format high yield plotter, including a central platen 12 intended to support the medium during printing and above which, there moves, the length of at least one guide bar, a carriage carrying the printer head (hidden in this case by the cover 11), intended to move, from one end to the other of the same, thus defining a printing area of the machine. Occasionally the carriage, carrying the printer head, moves towards one end of the machine, for example that designated with 14, in which a service station is located, to carry out cleaning of the nozzles and/or priming of the ink.

A feeder mechanism (of which the input guide roller 20 of this figure forms part) is utilised to achieve advance of the medium along a first feeder path through the machine, said feeder mechanism being comprised by a set of shafts and rollers which shall be described hereinafter. This feeder mechanism allows, in general, removal of the medium from the storage roll 16, causing it to pass through the printer, above the platen 12, where the printing operation is performed, and causing it to come out of the machine, after cutting it, to fall into a collector tray 18.

Said roller 20, assembled rotatively at its ends on both sides of the printer frame, can turn freely and facilitates input of the printing medium, guiding it in its entry into the machine and at the same time eliminating friction to which said medium would otherwise be subject and which could damage its surface on which it has to be printed. By way of example, said roller 20 can have a longitudinally slotted or striated surface to facilitate guiding the paper.

The printer 10 has a predefined printing area which coincides, at least partially, with a part of the feeder path of the medium, such that this is fed in through the printer area. One illustrative printer area is defined as that within which each one of the multiple nozzles of the printer head can print the entire width of the medium.

Figure 2:
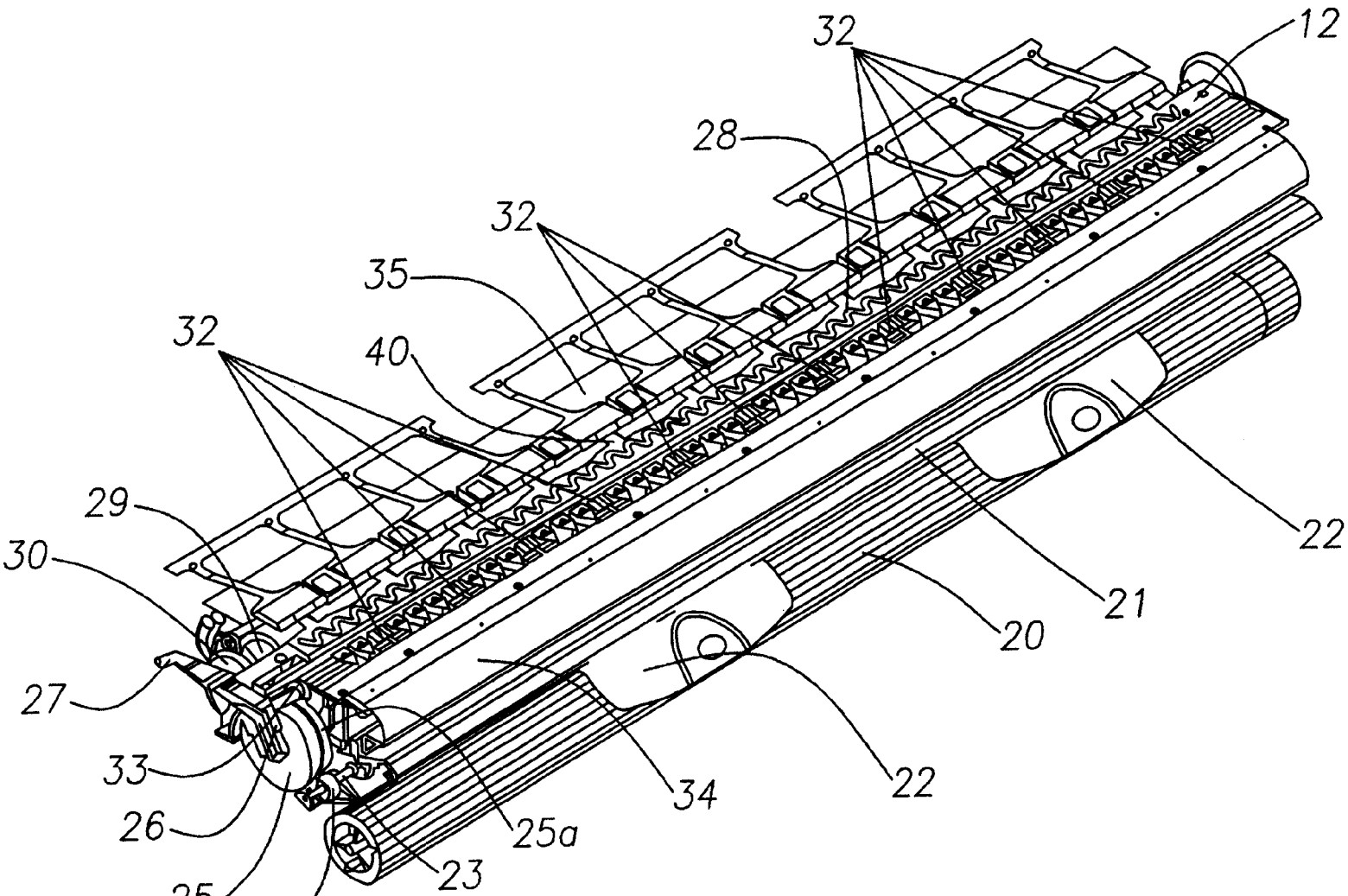
FIG. 2 is a perspective detailed view of the paper pulling mechanism and of the area of the printing platen of a printer such as that of FIG. 1, on a first operative stage.
Figure 3:
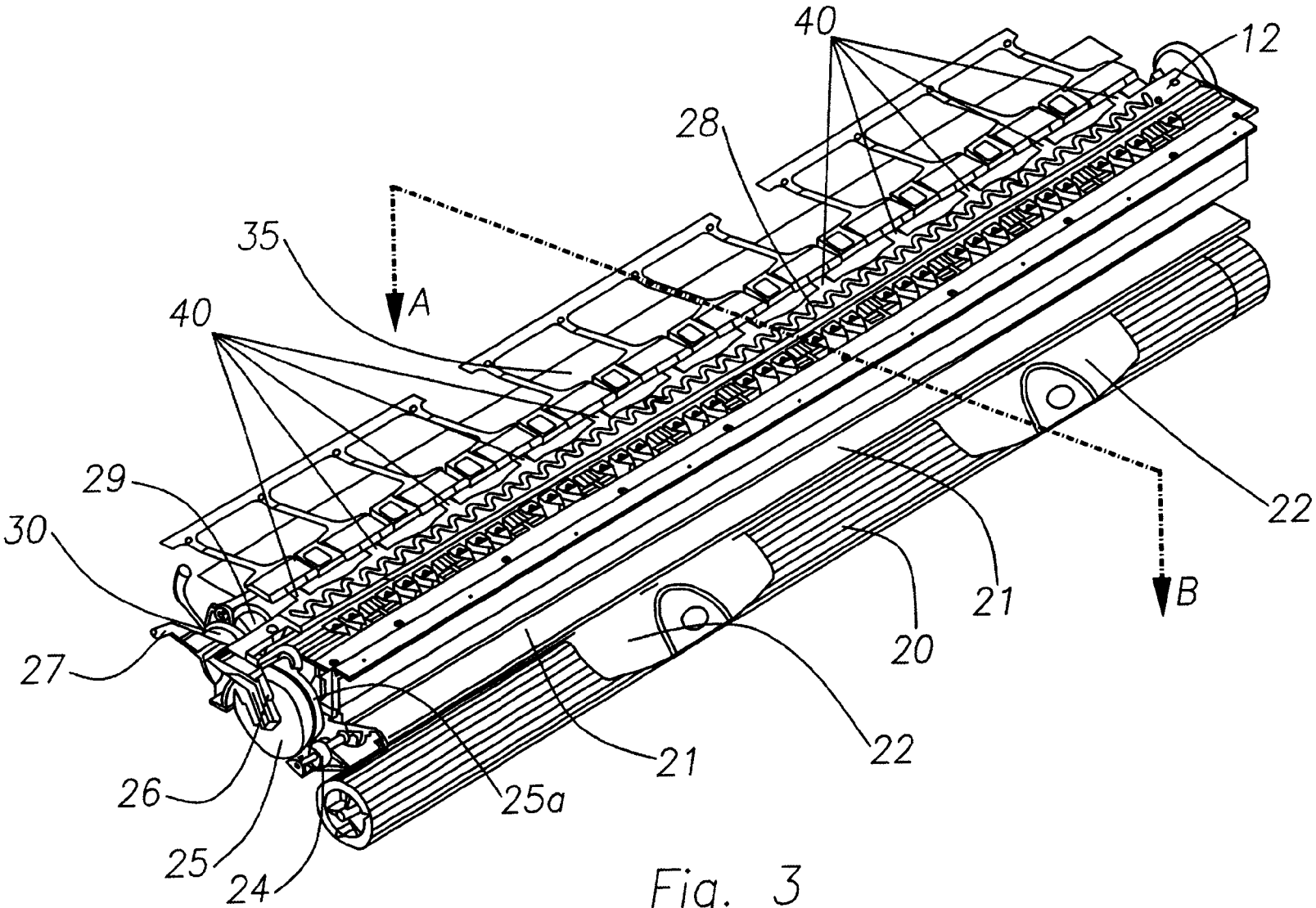
FIG. 3 is a view, similar to that of FIG. 2, on a second operative stage of the printer.
Figure 4:
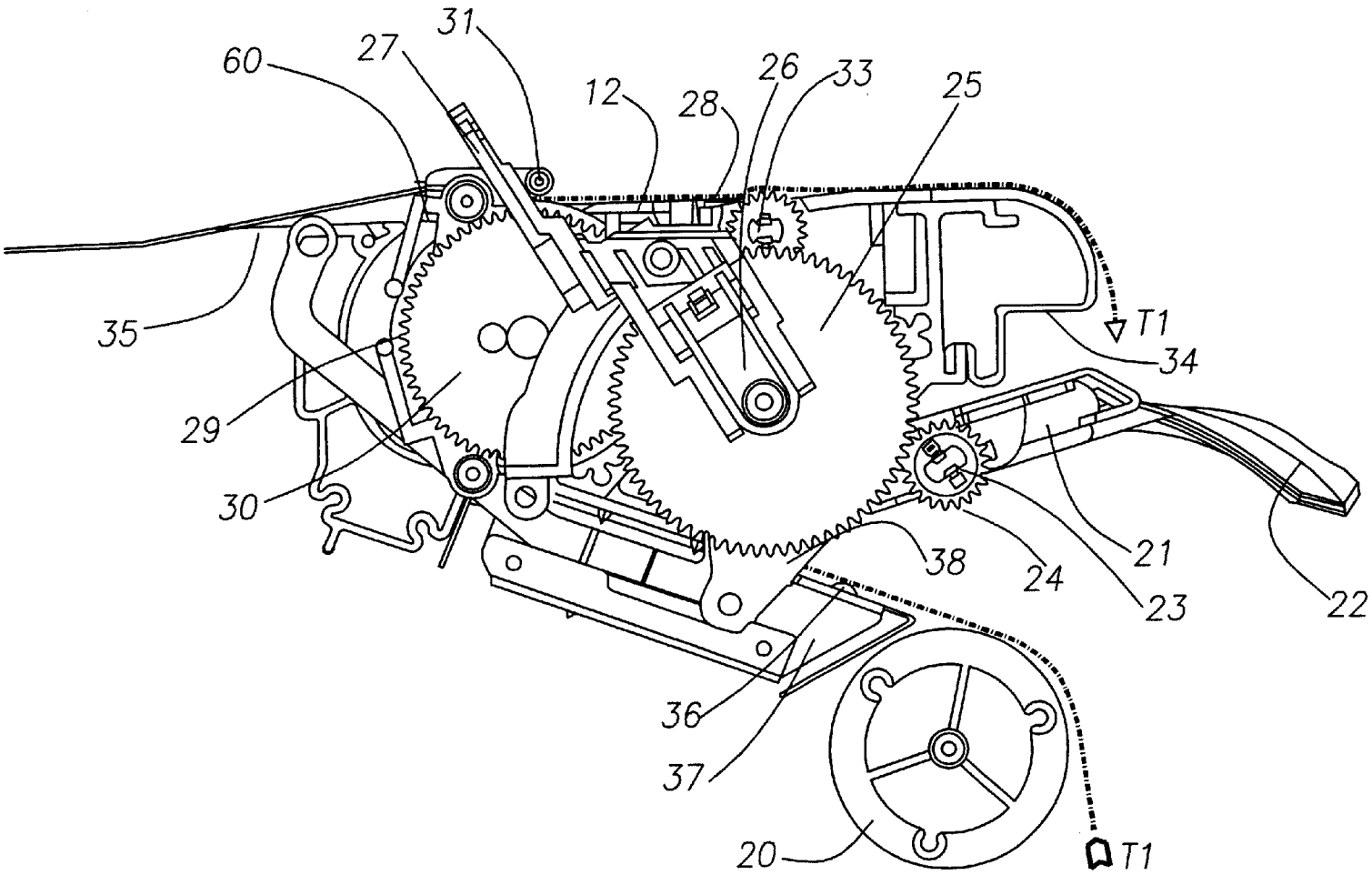
FIG. 4 is a schematic end view, showing the feeder mechanism of a printer in accordance with the invention, on a first operating stage corresponding to that represented in FIG. 2.
Figure 5:
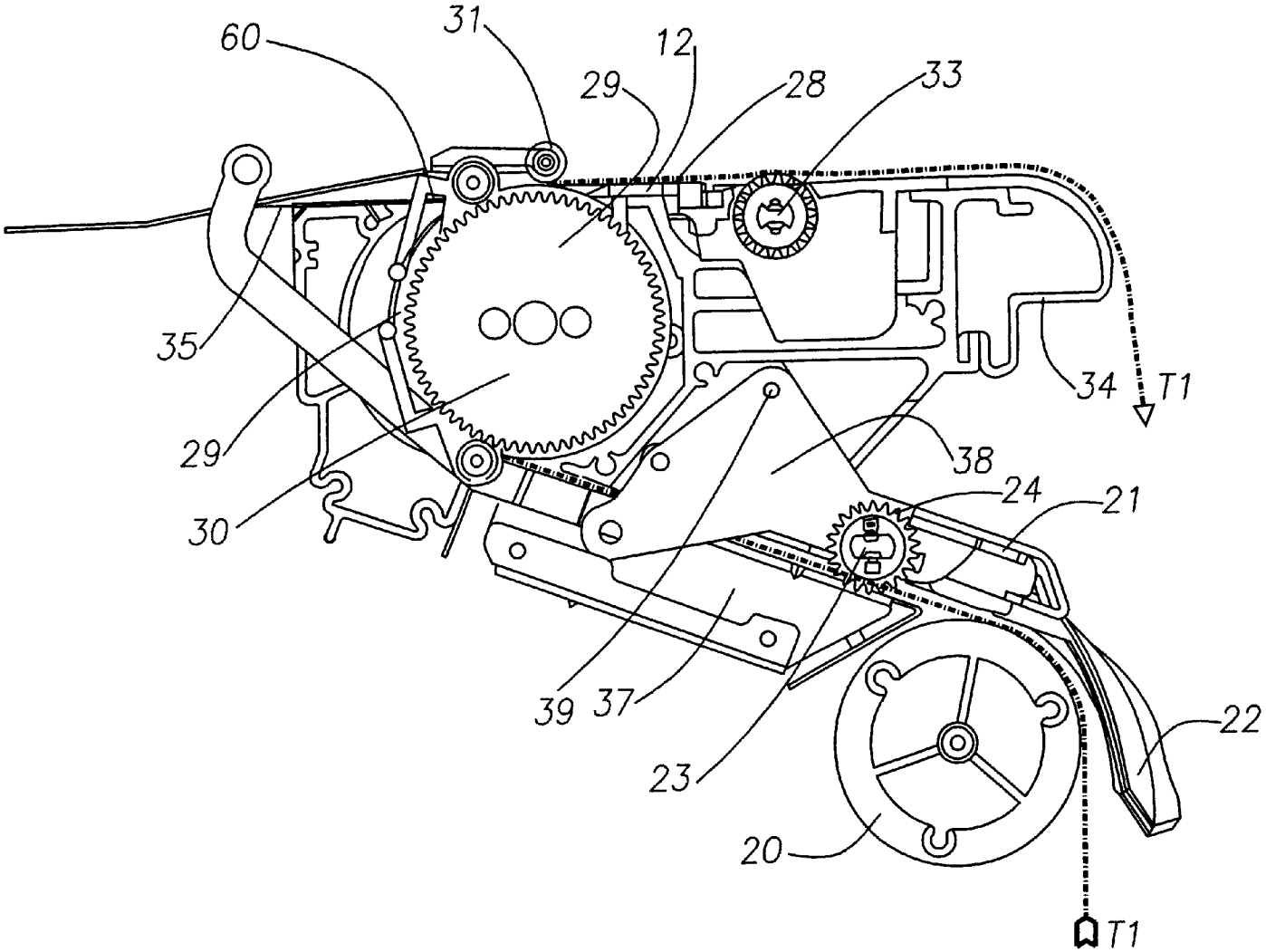
FIG. 5 is a view similar to that of FIG. 4, with parts withdrawn for greater clarity, but on a second operating stage corresponding to that shown in FIG. 3.

We shall make reference now to FIGS. 2 to 5 of the drawings, in which the spatial relationship is shown, of the components of the system for feeding the printing medium into the machine, there being represented in FIGS. 2 and 4 the printer with a swinging chassis 21 in a raised condition and, in FIGS. 3 and 5 in a lowered condition. In said figures there is indicated with 12 the central platen intended to support said medium during the printing operation, representing, with 34 and 35, respectively, the front and rear platens for supporting the medium while coming out of the machine. With 20 the roller is indicated, intended to guide the medium on entering the printer from its storage roll 16 (see FIG. 1). Above said roll 20 a swinging chassis 21 is provided, provided with flaps 22 to be moved manually by the operator between two positions: one above (FIGS. 2 and 4) in which it is to be found separated from said roller 20, and a lower one (FIGS. 3 and 5), in which it is to be found close to said roller 20. This swinging movement of the chassis 21 is achieved thanks to its pivoting assembly at 39 (See FIG. 5) in one and the other sides of the printer frame.

In said chassis 21 there is rotationally assembled an auxiliary axis 23 provided with a roller to pull the medium. Said axis 23 has a pinion 24 at one of its ends, which pinion 24 is to be found in constant contact with the toothed wheel 25. In the first position of said chassis 21, the said axis is separated from a roller 36 (see FIG. 4) assembled to turn freely in subchassis 37, while in said second position of said chassis 21, said at least one roller assembled in said axis 23 achieves being applied with said roller 36 to grasp between both the printing means supplied starting from said storage roll 16.

The toothed wheel 25 has, in its inner face looking towards the printing area, a toothed crown (not shown), intended to mesh, on being required to do so, with a corresponding toothed crown (not represented) formed in the face opposite another toothed wheel 25*a*, coaxial with it and permanently engaged to the main roller 29. The selective coupling of said toothed wheel 25 with the toothed actuating wheel 25*a* is achieved by movement of the former towards the latter on pushing the lever 26 to said toothed wheel 25 every time the carriage carrying the printer heads, under the control of the logic of the printer, reaches a determined end position, outside the printing area and impacts against part 27 of said lever 26.

The central platen 12 has a slot 28 with a zig-zag design, in which openings are provided (not illustrated) intended to allow the application of a vacuum, generated under said platen, to the upper face of this, on which the printing medium slides. The actuation of this vacuum is limited to the moment at which said medium is fed in, in the form of cut sheet, as shall be explained hereinafter. This platen 12 has ribs 40, equally spaced the length of the same and penetrating into mouths provided for the purpose in the main feeder roller 29 of the printer. The function of these ribs 40 shall be explained in more detail hereinafter, in relation to FIGS. 6A–6D.

In said FIGS. 2 and 3 there can also be seen the main feeder roller 29, actuated by means of a toothed wheel 30 meshed constantly with said toothed wheel 25*a*. With said roller 29 a pressure roller 31 operates (see FIGS. 4 and 5) for the purpose of grasping between both the printing medium and making it advance or retrocede during operation of the machine.

With 32 various rollers to pull the medium are designated, assembled in an axis provided, at one of its ends, with a pinion 33 in constant mesh with said toothed wheel 25*a*. These rollers 32 collaborate, too, with moving the medium in the printing area.

Finally, front and rear platens, 34 and 35, respectively, are provided, intended to support and to guide the medium to facilitate its coming out of the printing area and preventing said medium coming into contact with other mechanisms or cables of the machine and being damaged.

Reference will be made now, in particular, to FIGS. 3 and 5, being views similar to those of FIGS. 2 and 4, in which the same elements have been designated with the same reference numbers. In the first of them, the front platen 34 has been removed from the printer, so that the position can be more clearly seen, adopted by the chassis 21 when this is found in its lower swinging position, to which it has been taken by the operator on the latter pressing on the flaps 22 downwards. In FIG. 5 the toothed wheel 25 has been removed and the lever 26, 27 which moves it to couple with the toothed wheel 25*a*, so that the pivoting assembly, in 39, of the brackets 38 constituting the sides of the chassis 21 in the printer frame, can be seen more clearly.

The operation shall now be explained of the input system according to the invention, making reference for the purpose to FIGS. 6A–6D in particular, representing different operative phases of the machine.

Once the printer is connected, the user manually raises the chassis 21, pulling the flaps 22 upwards, to move it to its upper or open swinging position (see FIGS. 1 and 2). Next, he removes from storage roll 16 of the medium a determined length of the same and causes it to pass above the. input roller 20 and above the roller/s 36, along the path represented with lines in the form of dots and dashes in FIG. 6A, taking care the medium does not break or turn out damaged (for example, creased). The printer, thanks to the existence of a paper detector indicated in general manner with 50, advises the operator, for example by an acoustic signal, that the existence of the printing medium has been detected. Then the operator lowers the flaps 22 to bring the chassis 21 to its lower or closed swinging position, the medium being grasped between the roller 70 assembled in said axis 23 of the chassis 21 and the rollers 36. The medium is then made to advance towards the printing area, in the direction of the arrows adjacent to T1-T1 and FIG. 6A, around the main roller 29, to the flexible fingers 60, forcing them to divert upwards. These fingers 60 constitute the so-called valve for the medium and are to be found housed in the same periphery slots provided in roller 29 in which there is likewise housed the ribs 40 of the central platen 12. The medium thereafter passes above said central platen 12, said rollers 32 and, finally, coming out above said front platen 34. The path of the medium, in this condition, is indicated, as already stated, by the line comprised by dots and dashes T1-T1 in FIG. 6A, On arriving at this point, the machine interrupts advance of the medium, cutting it transverally to its direction of advance, the length of the entire platen 12, by means of a cutting device of the kind already known in the art, and remains in the stand by position for printing, alerting the operator of this by the usual acoustic signal. In this condition of stand by to print, of the machine, the continuous medium remains in the T1-T1 position of FIG. 6B, with the printer cover 11 in lowered position.

We shall now assume that the user decides to carry out a printing operation on said continuous medium. This will be made to advance as the printer head carries out said task, following the mentioned path T1-T1 (see the arrows of FIG. 6[a]) thanks to the cooperation of the main roller 29 with the roller 31, while the rollers 20, 36 and 70 turn freely. Once the printing task ends, the machine detains advance of the medium, makes a new cut the whole width of the printing area and the printing medium is left to fall on the collection tray 18 (FIG. 1), the continuous medium once again being left located in the printer in the condition represented in FIG. 6B with T1-T1.

If, then, the user decides to carry out a printing task on a cut sheet, he lifts the protecting cover 11 of the machine. Every time this step of lifting said cover 11 is performed a sensor or switch (not shown) is activated, controlled by it, causing the logic of the printer to order application to begin of a vacuum to the lower part of the central platen 12, vacuum which acts on the upper part of this thanks to the said perforations existing in said slot 28 of the platen. The operator can then place in position in the platen 12 a cut sheet, drawing assistance therefor from the slight retention which said vacuum exercises through said platen 12 on said cut sheet. Next the operator lowers the cover 11 to its closed position which activates the same switch and indicates to the printer that the user may have loaded a cut sheet. The printer performs a detection step of said cut sheet (presumed to be in the position designated with T2-T2) on the printing platen 12 by a detector provided in the carriage bearing the printer heads which, for the purpose, performs an exploration the width of said printing area.

If the user has not placed a single sheet on the platen 12, the printer does not detect its presence and moves on to a stand by condition, the carriage bearing the printing heads returning to its resting position and generation of the said vacuum being interrupted. On the contrary, if the user has in fact placed said cut sheet in the direction T2-T2, assisted by the action of the vacuum through said platen 12 to achieve its correct positioning, the printer detects its presence and proceeds to remove the continuous medium from the printing area and from the main roller 29 (in the direction of the arrows adjacent to the path T1-T1 in FIG. 6C) and, simultaneously, to take the cut sheet, pulling it in the direction of the arrows of path T2-T2.

Figure 6A:
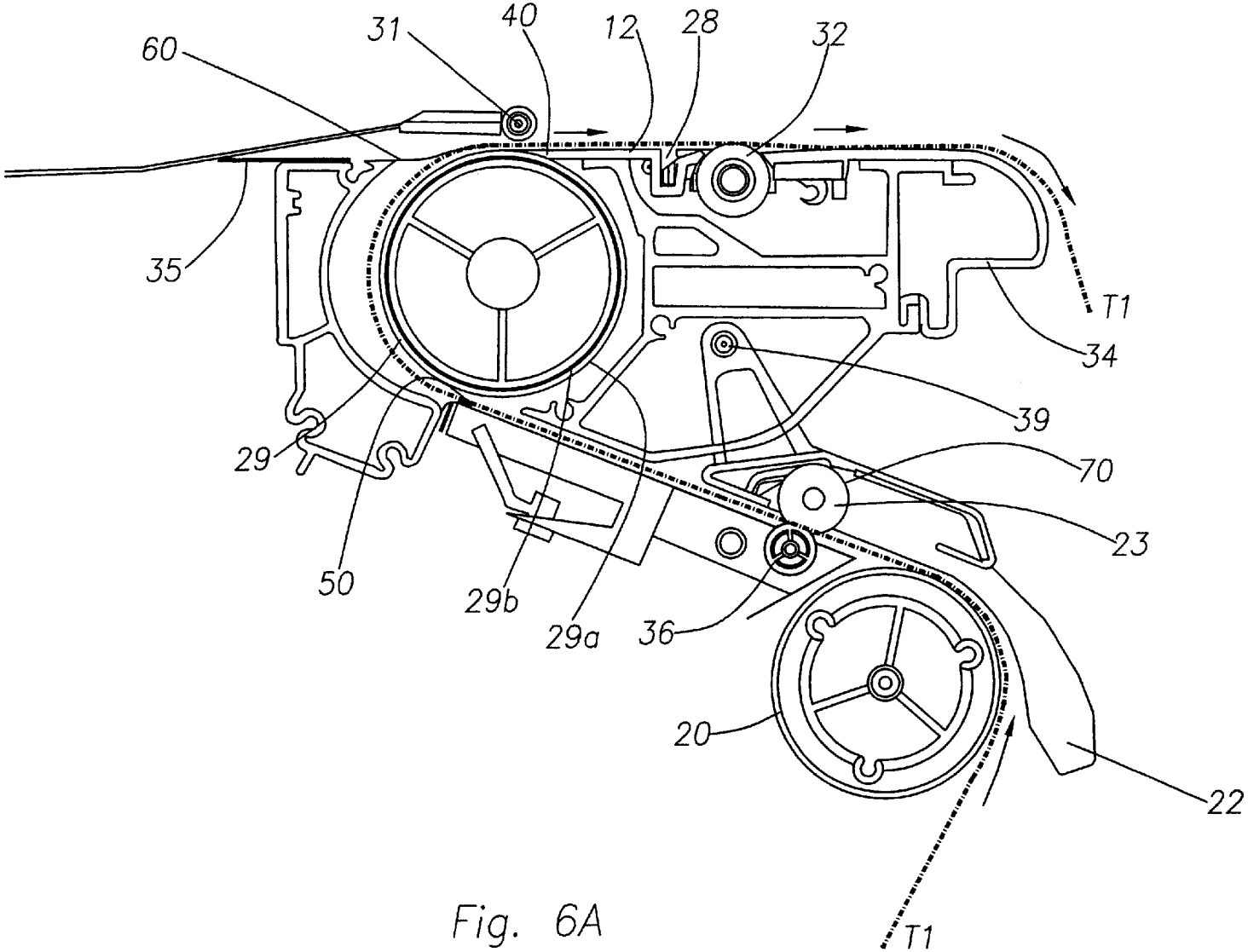
FIGS. 6A–6D are schematic views in cross section, taken along the line A–B of FIG. 3, representing different phases of operation of the printer according to the invention.
Figure 6B:
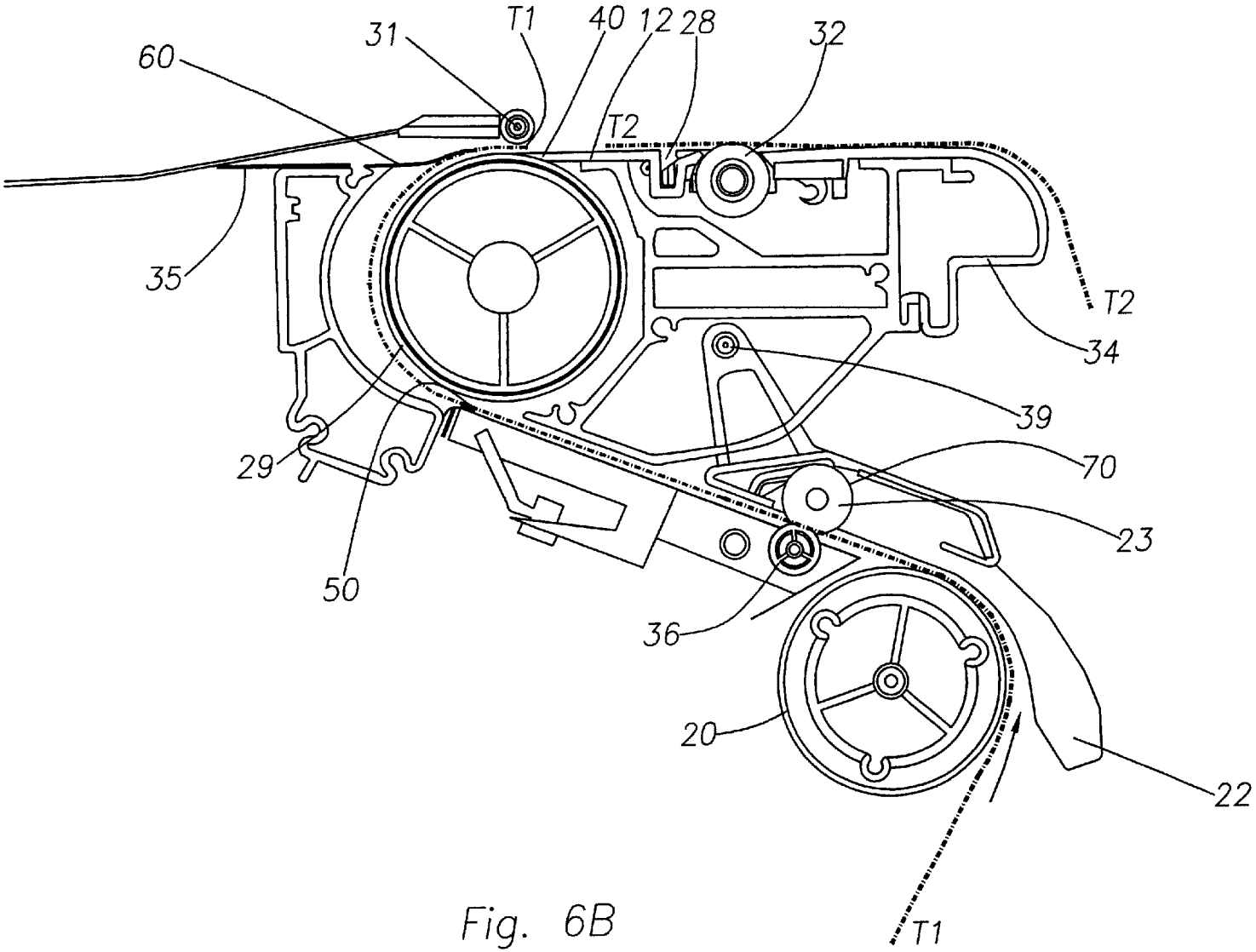
Figure 6C:
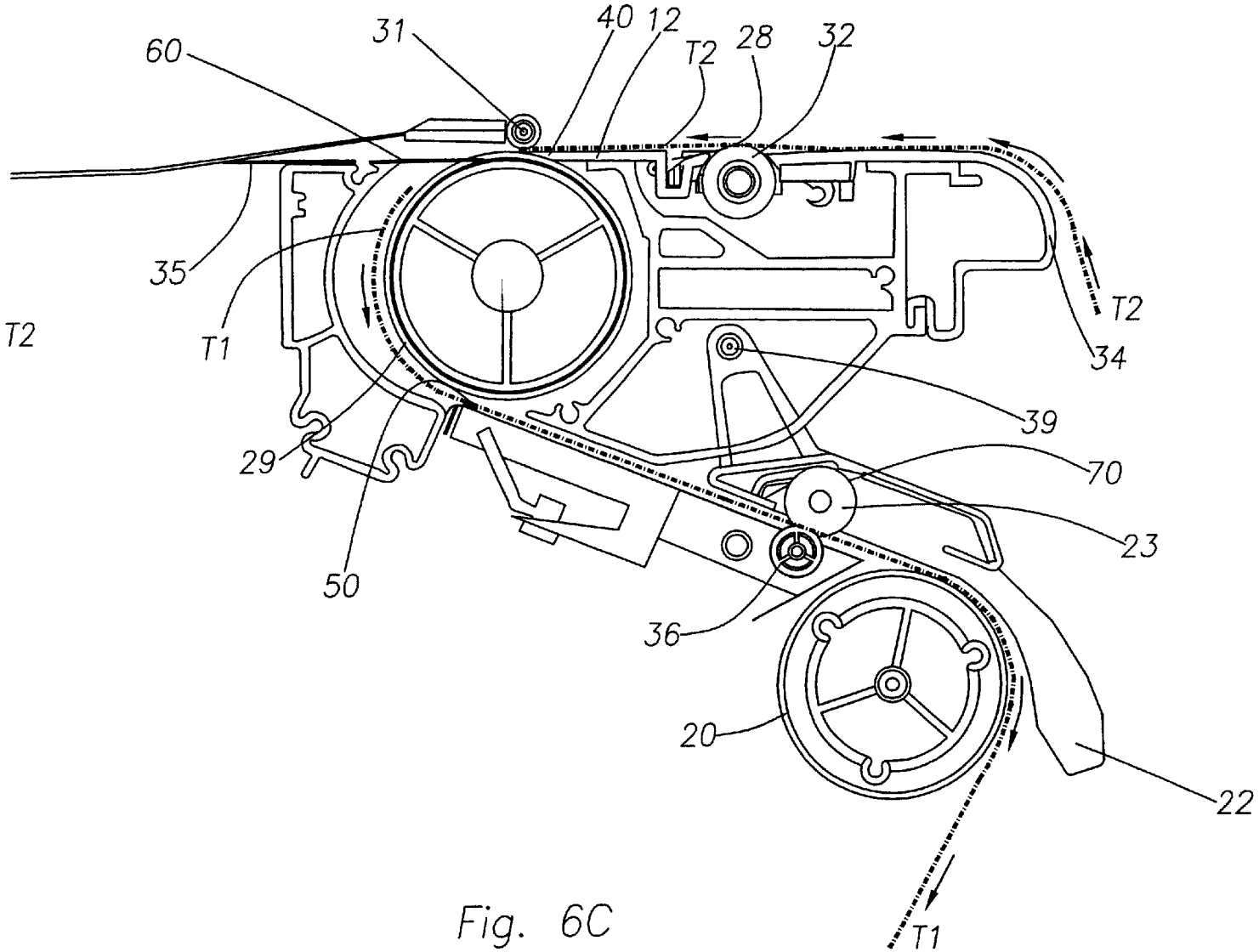
Figure 6D:
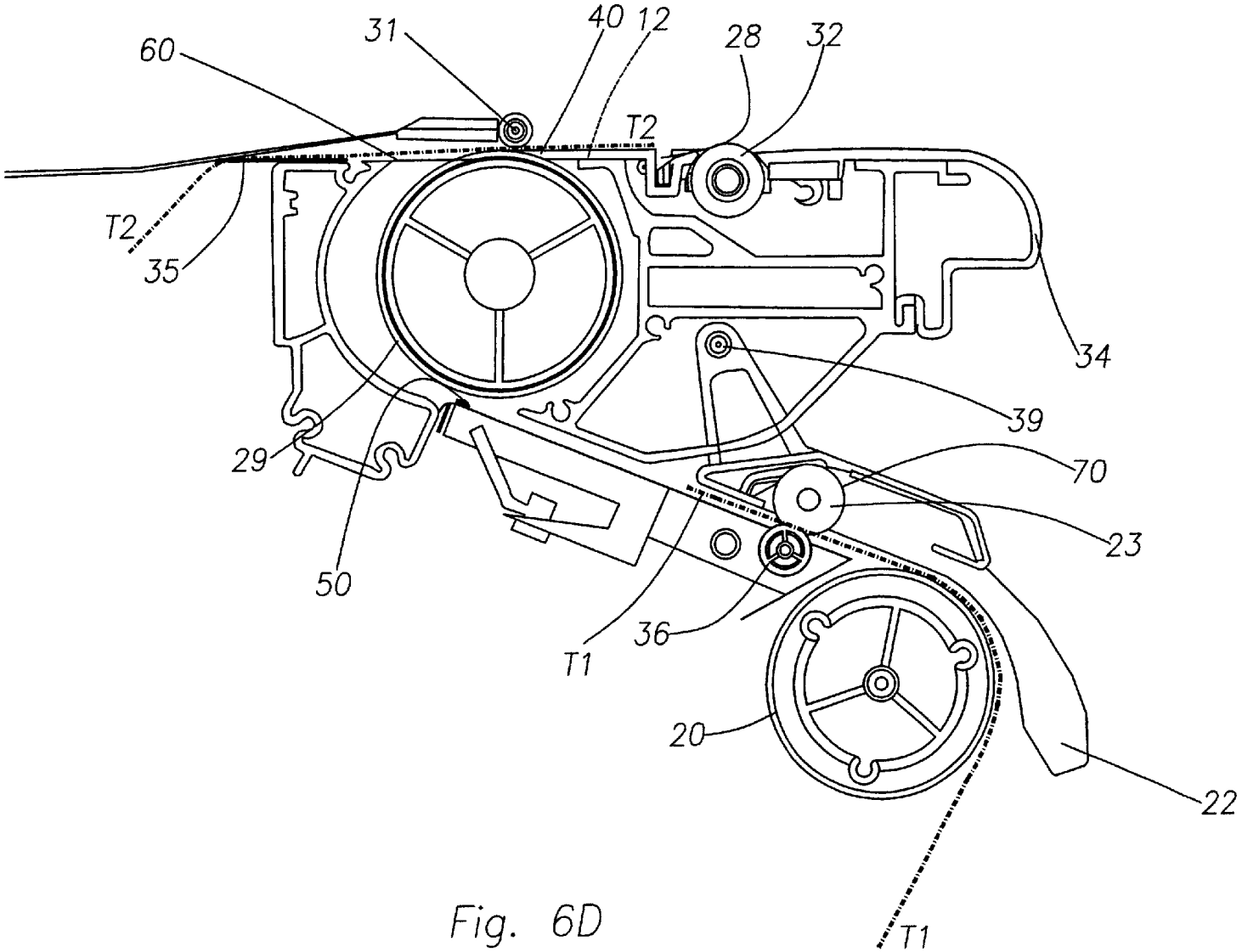

To carry out said change of printing medium, the said carriage bearing the printer heads moves outside the printing area, towards the end of the machine where the lever 27 is to be found, touching it and moving it such that the part 26 of said lever moves the toothed wheel 25 to couple it with the toothed wheel 25*a*, whereby the latter will transmit the actuation, through said toothed wheel 25 temporarily meshed with it and through the pinion 24, to the auxiliary axis 23, which will be made to turn in a first direction so that the roller 70, in cooperation with the roller 36, withdraws the medium downwards, until stopping at the position illustrated in FIG. 6D with T1-T1. Simultaneously with this removal of the continuous medium, the rollers 32, in cooperation with the vacuum applied on said cut sheet through the platen 12, pull this in the direction of the arrows adjacent to the path T2-T2 (FIG. 6C).

On removing the continuous medium T1-T1 from below the flexible fingers 60 of the valve of the medium, these have once again adopted their non-diverted position inside the slots of the roller 29, so that the medium in cut sheet form T2-T2 continues to move towards the left in FIG. 6C, passing above said fingers 60 and the rear platen 35, until reaching the position represented in FIG. 6D, following the necessary checks having been made as to position and alignment of said cut sheet in the printing area and the corresponding cutting of its front edge as perparation for a printing operation on it.

At this moment, with the continuous medium T1-T1 and the medium in cut sheet form T2-T2 in the positions represented in FIG. 6D, the printer has "parked" the continuous medium T1-T1, holding it between the roller 70 and the roller 36, the carriage bearing the heads ceasing to act on the lever 26, 27, said toothed wheels 25, 25*a* hence uncoupling themselves and the actuation for the auxiliary 70 axis therefore being interrupted, the machine then beginning the printing task on said cut sheet, once the cover 11 is lowered manually.

Once said printing task on the medium in cut sheet form ends, this is ejected from the machine and the tray 18 and the carriage bearing heads moves once again to act on the lever 26, 27 in order to transmit the actuation of the toothed wheel 25*a* to the axis 23 and, therefore, to the roller 70, but now in a second direction opposite to said first turning direction, such that the medium in band form continues to be fed automatically to the printing position represented with T1-T1 in FIG. 6B. At this moment, on the existence of said continuous medium being detected in this position, the carriage bearing the printer heads is returned to its resting position, separating itself from said lever 26, 27, whereby said toothed wheels 25, 25*a* uncouple and the actuation on the axis 23 and the roller 70 is interrupted, the printer once again remaining in the stand by condition on the medium in band form, with the cover 11 in closed position.

As from this moment, the machine is to be found in the same starting condition, i.e., with the continuous medium loaded in condition for printing on it, the printer cover in lowered position and in stand by to print condition.

It can be seen, from the above, that the feeder mechanism in accordance with embodiments of the invention offers a new solution to the problems that arise at the time of, in printing machines, using a media fed continuously from a roll of the same and, alternatively, a media in the form of cut sheets, on providing a printer of the type mentioned, having two different paths for feeding the media.

What is claimed is:

1. A printer for printing on a first medium in the form of a continuous band or on a second medium in the form of a sheet, in a print zone of the printer, the printer comprising:

a movable cover giving access to the print zone for loading said second media, a hold down system for holding said second media in position before and during printing, a first sensor to detect opening of the cover linked to said hold down system, storage means for storing said first medium, a feeder for moving said first medium from the storage means to the print zone, wherein when the cover is opened by a user of the printer the sensor activates the hold down system to accept said second medium without any further action by said user.

2. A printer as claimed in claim 1, wherein when the user closes the cover said first sensor detects this and activates the feeder to move the first medium away from the print zone to a standby position.

3. A printer as claimed in claim 1, further comprising a second sensor for detecting the presence of said second medium linked to the feeder and wherein when the presence of the second medium is detected the second sensor activates the feeder to move the first medium away from the print zone to a standby position.

4. A printer as claimed in claim 3, wherein said second sensor for detecting the presence of said second medium is activated when said first sensor detects that the cover has been closed.

5. A printer as claimed in claim 2 wherein the feeder normally holds an end of said first medium close to the print zone in a ready to print position.

6. A printer as claimed in claim 5, wherein as the feeder moves the first medium from said ready to print position to said standby position, the feeder simultaneously moves the second medium through the print zone.

7. A printer as claimed in claim 5, wherein once a printing operation on the second medium has been completed, the feeder moves the first medium from the standby position to the ready to print position without any action by the user of the printer.

8. A printer as claimed in claim 1, wherein the feeder comprises a driven roller and wherein the input to the feeder for the first medium is substantially on the opposite side of the roller from the input to the feeder for the second medium.

9. A printer as claimed in claim 8, wherein a first path of the first medium through the feeder passes around at least a quarter of the surface of the driven roller so that the first path is diverted by the roller and wherein a second path of the second medium through the feeder is substantially straight.

10. A printer as claimed in claim 9, wherein said first and second paths intersect close to the print zone and wherein the printer further comprises a valve for allowing both the first medium and the second medium to enter the print zone and for preventing the first medium from entering the second path and the second medium from entering the first path.

11. A printer as claimed in claim 3, further comprising a scanning carriage on which said second sensor for detecting the presence of the second medium is mounted.

12. A printer as claimed in claim 11, wherein motion of said scanning carriage actuates said feeder to move the first medium away from the print zone to the standby position.

13. A printer as claimed in claim 1, wherein said hold down system is a vacuum actuated hold down system.

* * * * *